United States Patent [19]

Lewis

[11] Patent Number: 4,463,869

[45] Date of Patent: Aug. 7, 1984

[54] TAMPER-EVIDENT SPICE CAN LID

[75] Inventor: Duane H. Lewis, Claysville, Pa.

[73] Assignee: Continental Plastics, Inc., Washington, Pa.

[21] Appl. No.: 520,508

[22] Filed: Aug. 4, 1983

[51] Int. Cl.[3] ..... B65D 39/00

[52] U.S. Cl. ..... 220/307; 220/270; 220/339; 222/153; 222/541

[58] Field of Search ..... 220/306, 339, 266, 270, 220/307; 215/235; 222/153, 541, 565, 569

[56] References Cited

U.S. PATENT DOCUMENTS

| | | | |
|---|---|---|---|
| 4,344,545 | 8/1982 | Aschberger et al. | 220/307 |
| 4,359,171 | 11/1982 | Lewis | 220/307 |
| 4,361,250 | 11/1982 | Foster | 220/266 |

*Primary Examiner*—George T. Hall

*Attorney, Agent, or Firm*—Parmelee, Miller, Welsh & Kratz

[57] ABSTRACT

A lid for use on dispensing containers which shows evidence of tampering either by opening of covers on the lid or by complete removal of the lid from the container, the lid having recesses in the top portion thereof wherein dispensing apertures are formed and covers for the recesses, one cover having a flap thereon which is frangibly connected to the cover along the sides of the flap and hinged to the cover at the rear portion of the flap with access to the flap only through an opening in the front wall formed by the recess. The other cover is hinged at the rear portion and has a groove therein transverse the same adjacent the front portion, with access to that cover only through an opening in the front wall formed by a second recess. The lid also has weakened sections along an outer skirt formed by vertical grooves, such that the lid can be removed only by fracturing one of the weakened sections and the one cover lifted only after breaking of the frangible side connections of the flap grasping the flap to raise engagement means on the cover from engagement with the walls of the aperture formed in the recess, and the other cover can be lifted only by flexing the front end of the cover along the transverse groove.

12 Claims, 10 Drawing Figures

TAMPER-EVIDENT SPICE CAN LID

The present invention is a lid for a dispensing can, such as a spice can lid, which provides apertures for spooning of ingredients from a container or sifting ingredients therefrom. The lid is constructed of a thermoplastic material and provides evidence of tampering with the container either through opening of covers for the apertures or through removal of the complete lid from a container.

Numerous constructions have been proposed that provide for evidence of tampering with a lid for a container. Such constructions have generally made use of separate bands or strips of material which must be removed from an assembly prior to removal of a container lid, such that absence or altering of the band or strip evidences that the lid may have been removed. In U.S. Pat. No. 4,244,479, a jar lid is shown which has a snap-on means and a skirt about the periphery that is enclosed by a cylindrical tear sleeve which extends axially from the outer edge of the lid and must be removed in order to expose a gripping surface on the lid for removal of the lid from the jar. The tear sleeve has an axially extending major tear groove, and a shortened portion adjacent this groove serves as a tab to grasp the tear sleeve and remove it entirely from connection with the lid. A minor tear groove is also provided for the tab and other minor tear grooves are disposed around the tear sleeve at intervals to provide evidence of tampering, such as by attempts to pry off the lid without removing the tear sleeve. In U.S. Pat. No. 4,361,250 a plastic container lid is disclosed having an integral cover for a dispensing opening in the lid in which side pieces on the cover, which are connected to the cover by frangible webs, are formed with pins which enter holes in the lid as the cover is initially closed. The ends of the pins are then heat staked, and shaped similar to a rivet, so that the cover can only be opened by tearing the middle of the cover free from the side pieces, which are permanently affixed. The cover has lugs which snap into the dispensing aperture in the lid to provide for reclosing the cover after it has first been opened. This construction requires a plurality of manufacturing steps in manufacture of the lid, including molding and heat staking.

An object of the present invention is to provide a tamper-evident lid, having a resealable cover, for use on dispensing containers such as spice cans, which lid can be formed in a single step.

Another object of the present invention is to provide a lid, having a resealable cover, that will show evidence of tampering, either by opening of the cover, removal of the entire lid from the container, or both.

BRIEF SUMMARY OF THE INVENTION

A thermoplastic tamper-evident dispensing lid has a top wall portion with spaced peripheral downwardly depending skirts to engage a container rim, the top wall having at least one recess which forms rear, side and front walls thereabout and a dispensing aperture in the recessed portion. A channel is formed about the edge of the recess and a cover, hinged to the rear wall of the recess, has a locking lip that engages a wall of the dispensing aperture, and a flange which fits within the channel, when the lid is in closed position, with the top surface of the cover being flush with or below the top surface of the top wall when the cover is closed. The cover has a flap at the front portion that has frangible securement at the sides to the cover and a hinged connection at the rear, and a gap is present in the front wall of the recess adjacent the flap, such that access to the cover, when closed, to open the same, is only through the flap which must be lifted by breaking away of the frangible connection, thereby indicating to the user that the cover has been previously opened. Preferably, a second smaller recess is formed in the top wall of the lid, with a smaller cover adapted to overlie that recess, the smaller, or sifting, cover having a groove in the top wall thereof adjacent a second gap formed in the front wall of the smaller recess, the cover having a locking lip that engages with a wall of a dispensing aperture in the second recess, whereby after an initial opening of the second cover, the portion of the cover between the groove and the gap in the front wall will not be returnable to a flush closed position, while the locking lip will engage and close the aperture to seal the same.

The spaced peripheral downwardly depending skirts on the lid comprise an inner skirt which frictionally engages with engagement means on the inner rim of the container, and an outer skirt which has a plurality of vertically extending grooves formed therein to provide a plurality of weakened sections about the outer skirt. Attempts to pry the entire lid from frictional engagement with the container will cause at least one of the weakened sections to break away from the outer skirt and thereby indicate to a user that the lid has previously been removed from the container.

DETAILED DESCRIPTION

Figure 1:
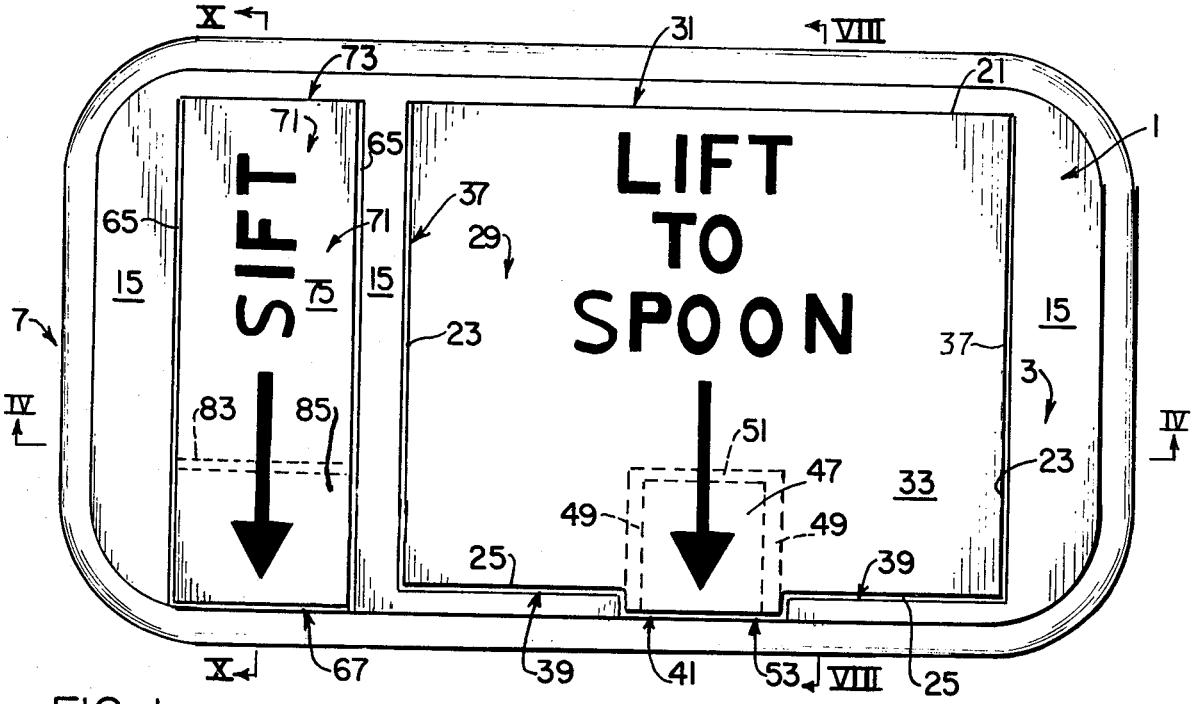
FIG. 1 is a top plan view of the tamper-evident dispensing lid of the present invention showing two covers on the lid in closed and locked position.
Figure 2:
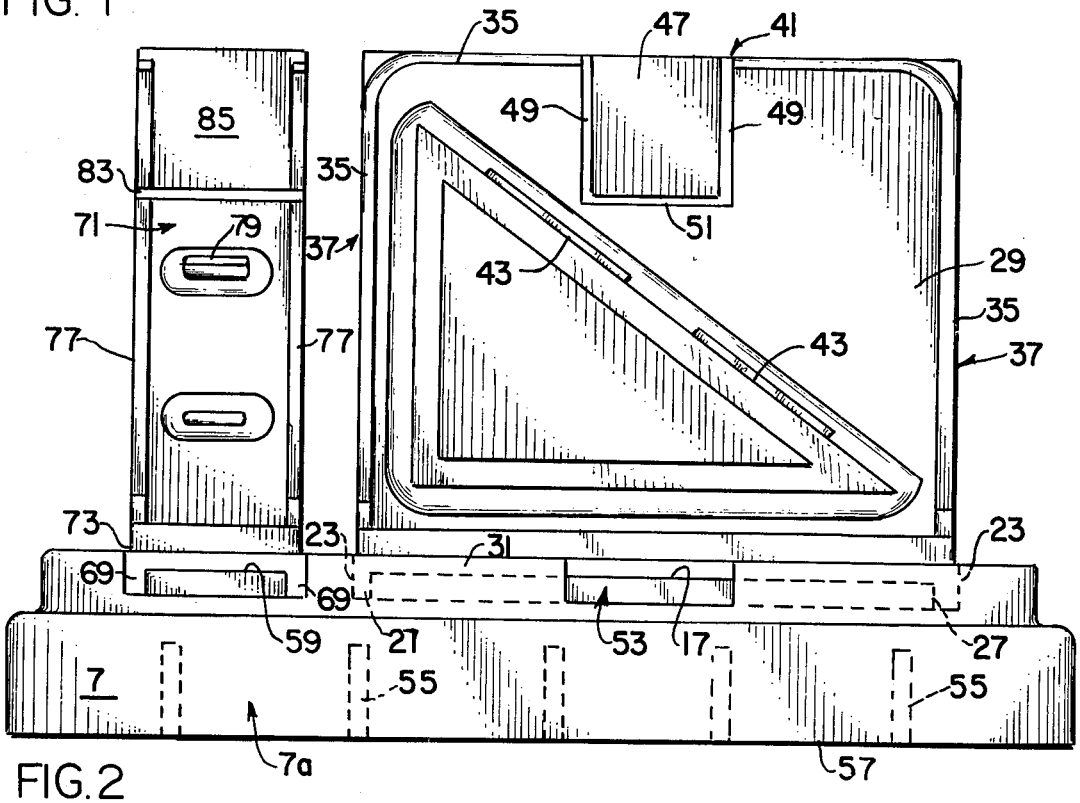
FIG. 2 is a front view of the lid of FIG. 1 showing both covers in raised position.
Figure 3:
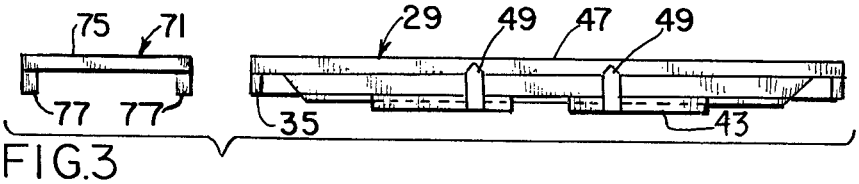
FIG. 3 is a front view of the two covers shown on the lid of FIG. 1.
Figure 4:
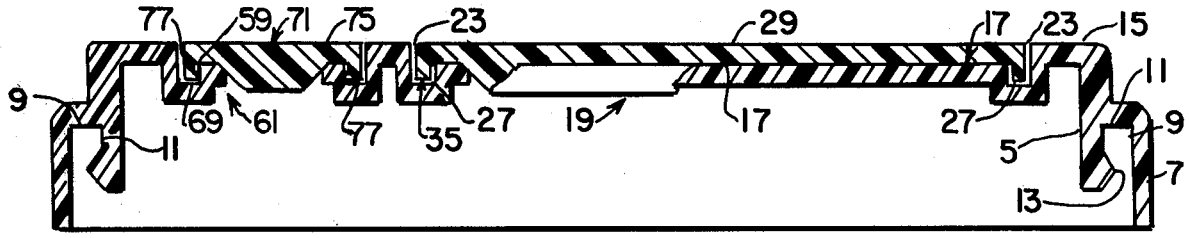
FIG. 4 is a cross-sectional view of the lid along, line IV—IV of FIG. 1, through a locking tab on the sifting cover and a locking tab on the spooning cover.

As illustrated in the drawings, the present tamper-evident lid 1 is preferably of a rectangular shape with rounded corners to fit conventional spice cans. The lid has a top wall portion 3 and a pair of downwardly depending skirts about the periphery thereof. The skirts comprise an inner skirt 5 and an outer skirt 7, with the skirts fitting over the rim 9 of a container to frictionally engage the lid to the container. Preferably, the container rim has an inwardly directed locking bead 11 on the interior thereof which will engage with a lip 13 on the outer wall of the inner skirt 5. The lid has, in the top wall portion 3, an upper surface 15 and at least one recessed portion 17 therein. As illustrated, the upper surface 15 of the top wall portion has a recessed portion 17 and an aperture 19 in the recessed portion for spooning ingredients from the container. The recessed portion 17 forms rear wall 21, side walls 23 and a front wall 25 within the top wall portion 3. A channel 27 is formed in the recessed portion 17 around the edge thereof which extends around the front wall 25 and side walls 23.

A cover 29 is provided which is integrally hinged at 31 to the rear wall 21 adjacent the top wall portion 3. The cover 29 has a top surface 33 and a downwardly depending flange 35 that extends along the end of the cover, along both side walls 37 of the cover and along the front wall 39 of the cover with a break 41 provided along the front wall. The downwardly depending flange 35 fits within the channel 27 of the recess when the cover is in closed position, while the top surface 33 of the cover is flush with, or slightly below, the upper surface 15 of the top wall portion 3. The cover 29 has a depending locking lip, or lips, 43 which will engage with a wall 45 of the aperture 19, when the cover is snapped closed, to seal the aperture 19.

At the front portion of the cover 29, there is a flap 47, the flap 47 having frangible connections along sides 49 and being integrally hinged at 51, its rear portion, with the cover 29. The frangible connection along sides 49 is such that lifting of the flap 47 will cause the side portions to break away from the cover, while the flap will bend upwardly along hinge 51, and the locking lip 43 will retain the cover 29 in closed position.

A gap 53 is provided in the front wall 27 of the recess 17 adjacent the flap 47 of cover 29 so that access to the edge of the cover 29 is only at the flap portion.

Figure 5:
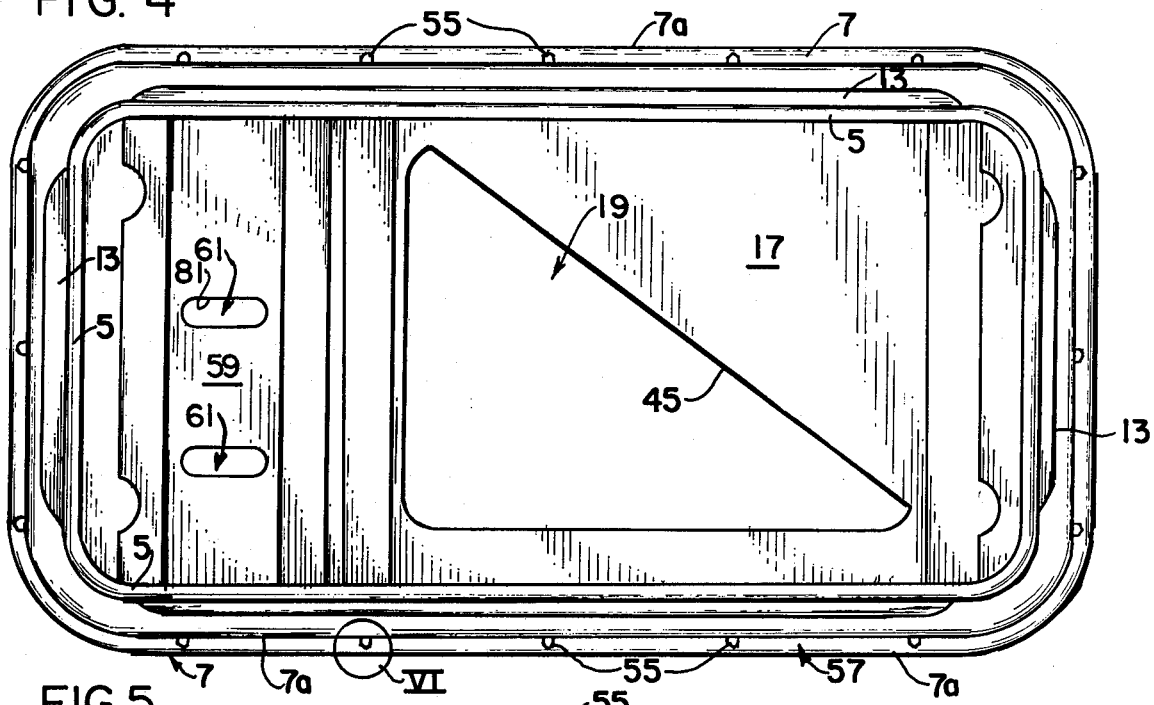
FIG. 5 is a bottom view of the lid with the covers raised to show the dispensing apertures.
Figure 6:
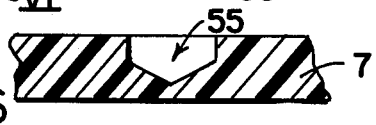
FIG. 6 is an enlarged view indicated as VI in FIG. 5.
Figure 7:
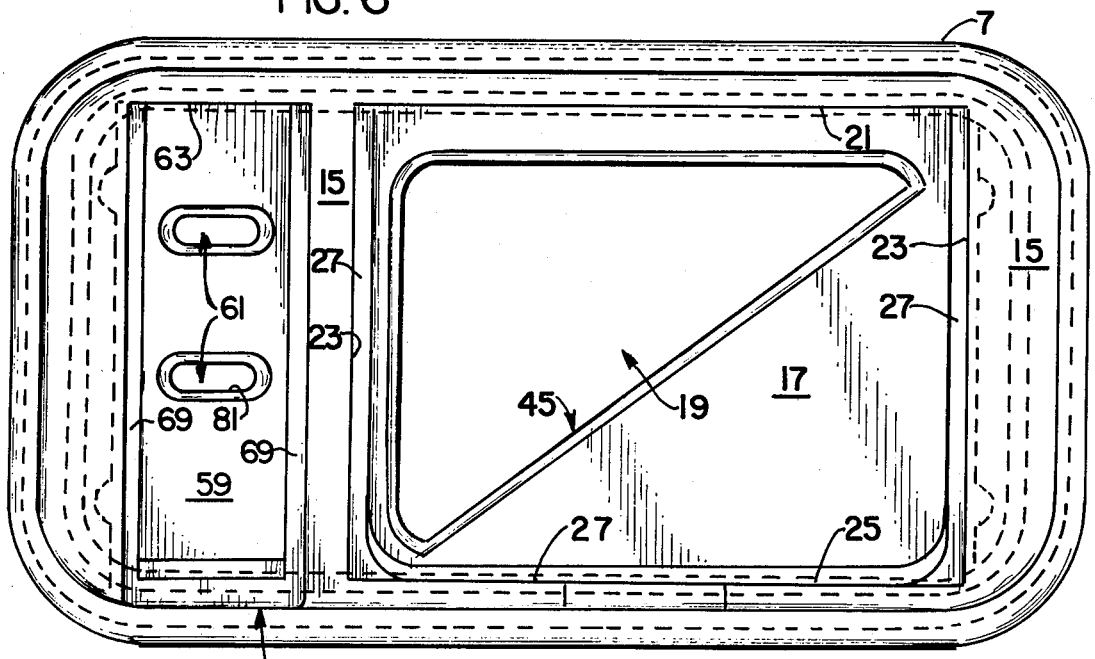
FIG. 7 is a top plan view of the lid of FIG. 1 with the covers removed for clarity.
Figure 8:
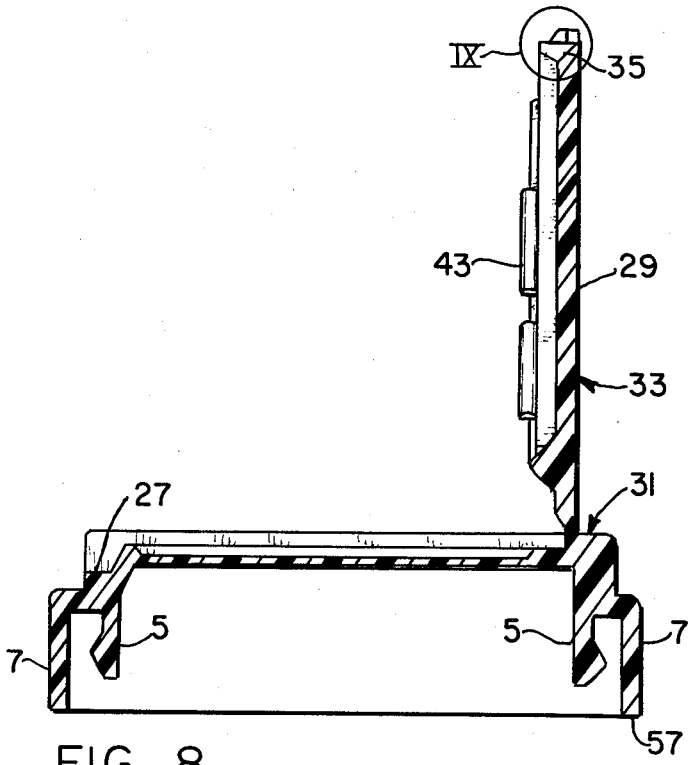
FIG. 8 is a cross-section of the spooning cover taken along lines VIII—VIII of FIG. 1.
Figure 9:
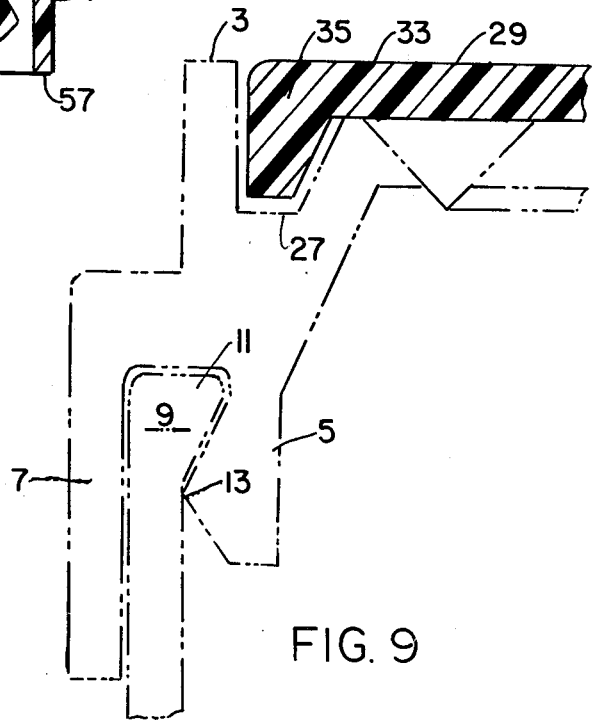
FIG. 9 is an enlarged view indicated at IX in FIG. 8 showing the closed position of the cover.
Figure 10:
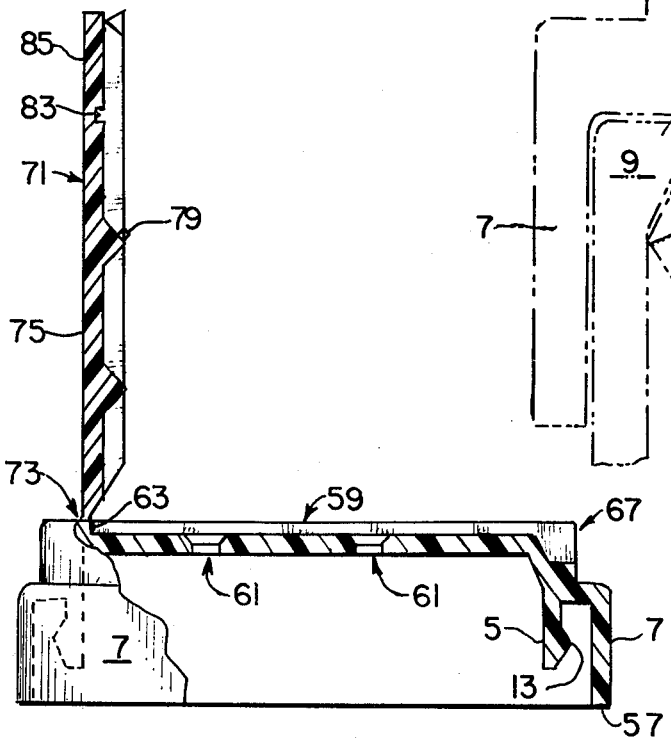
FIG. 10 is a cross-section of the sifting cover taken along line X—X of FIG. 1, but with the cover in raised position.

In the preferred embodiment, the lid 1 has means for indicating tampering with the contents of the can by removal of the entire lid 1 from the container rim 9. As previously described, the inner skirt 5 (FIG. 5) has a locking lip 13 which engages with an inwardly directed locking bead 11 on the container rim 9. The outer skirt 7 is provided with a plurality of spaced vertically extending grooves 55, the grooves 55 extending from the bottom wall 57 of the skirt 7 to a position adjacent the top wall portion 3 of lid 1. The grooves 55 form a plurality of weakened sections **7*a* about the outer skirt 7, such that any attempt to pry the lid 1 from engagement with the container rim 9 will result in breaking away of a section 7*a*, due to the locking engagement of the lip 13 of inner skirt 5 with the locking bead 11 of the container rim 9**.

In another preferred embodiment, the lid has a second smaller recess 59 formed in the top wall 3, and apertures 61 in the second recessed portion for sifting contents from the container. The second recessed portion formes a rear wall 63, side walls 65 and a front opening 67 within the top wall portion 3. Channels 69 are formed in the second recessed portion 59 which extend along the side walls 65.

A second cover 71 is provided which is integrally hinged at 73 to the rear wall 63 adjacent the top wall portion 3. The second cover 71 has a top surface 75 and downwardly depending flanges 77 along the sides of the cover. The flanges 77 fit within the channels 69 of the recess when the cover is in closed position, while top surface 75 of the second cover is flush with, or slightly below, the upper surface 15 of the top wall portion 3. The second cover 71 has a depending locking lip, or lips 79, which will engage with a wall 81 of an aperture 61, when the cover is snapped closed, to seal the aperture 61.

Adjacent the front portion of the second cover 71 there is a groove 83 which extends transversely completely across the cover, the groove being sufficiently deep such that upon initially lifting the cover from the front, the cover must be flexed along groove 83 so as to release the locking lip 79, and the front portion 85 thereof will not return to a normal lay-flat position, but will be somewhat flexed upwardly along the groove 83. Thus, while the locking lip 79 on second cover 71 will hold the main portion of the cover flush with the upper surface 15 of the top wall 3, when the cover is then closed, the front portion 85 will not be held flush therewith.

The present lid is usable especially in connection with spice cans, or other containers for dispensing material, where a tamper-evident construction is desired. In using the lid 1, the lid is snapped onto the container, with the rim 9 frictionally engaged between skirts 5 and 7, the bead 11 of the container rim engaging with the lip 13 of the skirt 5. The cover 29 is in closed position, seated in recess 17, with the top surface 33 of the cover flush with, or below, the upper surface 15 of top wall 3 of the lid 1. The cover 29 is locked in place by engagement of locking lip 43 with a wall 45 of aperture 19 in the recess 17. With the cover 29 so secured and positioned, access to the underside of the cover 29, in order to lift the same, is only through the gap 53 in the front wall 25 of the recess 17, where the flap 47 is exposed.

In order to initially raise the cover 29, the user must grasp the flap 47 of the cover, which is exposed at the gap 53 in front wall 25, and upon lifting, the frangible connection with the cover, along the walls 49, will be broken. The cover 29 will still be retained in closed position, by engagement of locking lip 43 with a wall 45 of aperture 19 in recess 13, until the flap is raised and provides a sufficient grip for the user to pull on the flap and overcome the locking forces.

The second cover 71 is also in closed position, seated in second recess 59, with the top surface 75 of the second cover flush with, or below, the upper surface 15 of the top wall 3 of the lid 1. The cover 71 is locked in place by engagement of locking lip 79 with a wall 81 of aperture 61 in the second recess 59. With the second cover 71 so secured and positioned, access to the underside of the second cover 71 in order to lift the same is only through front opening 67.

In order to initially raise the second cover 71, the user must grasp the front portion 85 of the second cover, which is exposed, and upon lifting, the front portion will flex along groove 83, while the main portion of the cover remains in closed position, by engagement of locking lip 79 with a wall 81 of aperture 61, until the front portion is sufficiently raised to provide a grip for the user to pull on the front portion and overcome the locking forces.

A purchaser of a closed container will then be able to tell if the cover 29 has ever been opened, by the breaking of the frangible connection 49 of the flap 47 in the cover 29, or whether the second cover 71 has even been opened, by flexing along groove 83, since the front portion thereof will not lay flat as will the main portion which is locked. In the event that one should try to pry open the cover 29 without use of the flap 47, or second cover 71 without flexing front portion 85, the position of the top surfaces 33 and 75 flush with, or below, the top surface 15 of the top wall 3, and seating of the flanges 35 in channel 27, and flanges 77 in channels 69, prevents access. If such attempts are made to pry the cover open, marking of the top surface would result.

In the event that one would attempt to remove the complete lid 1 from the container, the locking of the cover, through bead 11 of the rim 9 and lip 13 on inner skirt 5, is such that a weakened portion 7*a* of the outer skirt 7, formed by grooves 55, will break away to give evidence of removal of the lid 1.

The lid of the present invention can be readily molded from a thermoplastic material in a single manufacturing step and provides evidence of tampering to a user, either by opening of the covers or by complete removal of the lid.

What is claimed is:

1. A thermoplastic tamper-evident dispensing lid having a resealable cover thereon, for closing a container having a rim about the mouth thereof, the lid comprising:

a top wall portion having inner and outer integral downwardly depending spaced skirts about the periphery thereof, and engaging means on at least one of the skirts to frictionally engage the rim of the container to lock the lid to the container when the rim is placed between said skirts;

the top wall portion having an upper surface and a recess therein forming rear, side and front walls about the recess, and a dispensing aperture within the recessed portion;

a resealable cover integrally hinged adjacent the rear wall of said recess, the top surface of the cover being no higher than the upper surface of top wall portion of the lid when the cover is in closed position;

a depending locking lip on the cover engageable with a wall of the aperture in the recess to lock the cover in closed position and seal the aperture;

the cover having a flap at the front portion thereof, the flap being integrally hinged, at the rear portion thereof with the cover and frangibly secured, along the side portions thereof, with the cover; and a gap in the front wall of said recess, adjacent said flap, providing access to said flap when the cover is in closed position.

2. A thermoplastic tamper-evident dispensing lid as defined in claim 1 where the top surface of said cover is flush with the upper surface of the top wall portion of the lid when the cover is in closed position.

3. A thermoplastic tamper-evident dispensing lid as defined in claim 1 wherein the top surface of said cover is below the upper surface of the top wall portion of the lid when the cover is in closed position.

4. A thermoplastic tamper-evident dispensing lid as defined in claim 1, wherein the recess has a channel formed therein about the edge thereof, extending along the front and side walls thereof, and the cover has a downwardly depending flange extending along the edge thereof which fits in said channel when the cover is in closed position.

5. A thermoplastic tamper-evident dispensing lid as defined in claim 1 for closing a container having a rim about the mouth and an inwardly directed locking bead thereon wherein the inner skirt has engaging means thereon to frictionally engage the bead on the rim of the container, and the outer skirt has a plurality of vertically extending grooves therein which provide a plurality of weakened sections about the outer skirt, such that prying of the lid from frictional engagement with the container will cause at least one of said weakened sections to break away from the remainder of the outer skirt.

6. A thermoplastic tamper-evident dispensing lid as defined in claim 1 wherein the top wall portion has a second smaller recess in the upper surface thereof forming second rear and side walls about the second recess and a front opening in the top wall, and at least one dispensing aperture within the second recessed portion;

a second resealable cover hinged adjacent the rear wall of the second recess, the top surface of the second cover being no higher than the upper surface of the top wall portion of the lid when the second cover is in the closed position;

a depending locking lip on the second cover engageable with a wall of one of said apertures in the second recess to lock the cover in closed position and seal the aperture;

the cover having a groove therein adjacent the front edge of the cover; and the front opening, formed by the second recess, providing access to said second cover when the cover is in closed position.

7. A thermoplastic tamper-evident dispensing lid as defined in claim 6, wherein the top surface of the second cover is flush with the upper surface of the top wall portion of the lid.

8. A thermoplastic tamper-evident dispensing lid as defined in claim 6, wherein the second recess has channels formed therein extending along the side walls thereof, and the second cover has downwardly depending flanges extending along the edge thereof which fit in said channels when the second cover is in closed position.

9. A thermoplastic tamper-evident dispensing lid as defined in claim 6 for closing a container having a rim about the mouth and an inwardly directed locking bead thereon wherein the inner skirt has engaging means thereon to frictionally engage the bead on the rim of the container, and the outer skirt has a plurality of vertically extending grooves therein which provide a plurality of weakened sections about the outer skirt, such that prying of the lid from frictional engagement with the container will cause at least one of said weakened sections to break away from the remainder of the outer skirt.

10. A thermoplastic tamper-evident dispensing lid having a resealable cover thereon, for closing a container having a rim about the mouth and an inwardly directed locking bead thereon, the lid comprising:

a top wall portion having inner and outer integral downwardly depending skirts about the periphery thereof, the inner skirt having engaging means thereon to frictionally engage the bead on the rim of the container, to lock the lid to the container when the rim is placed between said skirts, and the outer skirt having a plurality of vertically extending grooves therein which provide a plurality of weakened sections about the outer skirt, such that prying of the lid from frictional engagement with the container will cause at least one of said weakened sections to break away from the remainder of the outer skirt;

the top wall portion having an upper surface and a recess therein forming rear, side and front walls about the recess, and a dispensing aperture within the recessed portion;

a resealable cover integrally hinged adjacent the rear wall of said recess, the top surface of the cover being no higher than the upper surface of the top wall portion of the lid when the cover is in closed position;

a depending locking lip on the cover engageable with a wall of the aperture in the recess to lock the cover in closed position and seal the aperture;

the cover having a flap at the front portion thereof, the flap being integrally hinged, at the rear portion thereof with the cover and frangibly secured, along the side portions thereof, with the cover; and a gap in the front wall of said recess adjacent said flap providing access to said flap when the cover is in closed position.

11. A thermoplastic tamper-evident dispensing lid as defined in claim 10 wherein the top wall portion has a second smaller recess in the upper surface thereof forming second rear and side walls about the second recess and a front opening in the top wall, and at least one dispensing aperture within the second recessed portion;

a second resealable cover hinged adjacent the rear wall of the second recess, the top surface of the second cover being no higher than the upper surface of the top wall portion of the lid when the second cover is in the closed position;

a depending locking lip on the second cover engageable with a wall of one of said apertures in the second recess to lock the cover in closed position and seal the aperture;

the cover having a groove therein adjacent the front edge of the cover; and the front opening, formed by the second recess, providing access to said second cover when the cover is in closed position.

12. A thermoplastic tamper-evident dispensing lid as defined in claim 11 wherein the top surface of both said covers is flush with the upper surface of the top wall portion of the lid.

* * * * *